United States Patent [19]

Aldridge et al.

[11] 4,111,787

[45] Sep. 5, 1978

[54] STAGED HYDROCONVERSION OF AN OIL-COAL MIXTURE

[75] Inventors: Clyde L. Aldridge; Roby Bearden, Jr., both of Baton Rouge, La.

[73] Assignee: Exxon Research & Engineering Co., Linden, N.J.

[21] Appl. No.: 858,546

[22] Filed: Dec. 8, 1977

Related U.S. Application Data

[63] Continuation-in-part of Ser. No. 702,271, Jul. 2, 1976.

[51] Int. Cl.[2] ..... C10G 1/08

[52] U.S. Cl. ..... 208/10

[58] Field of Search ..... 208/10

[56] References Cited

U.S. PATENT DOCUMENTS

| | | | |
|---|---|---|---|
| 3,502,564 | 3/1970 | Hodgson | 208/10 |
| 3,532,617 | 10/1970 | Hodgson | 208/10 |
| 3,813,329 | 5/1974 | Gatsis | 208/10 |
| 4,077,867 | 3/1978 | Aldridge et al. | 208/10 |

*Primary Examiner*—Delbert E. Gantz
*Assistant Examiner*—Joan Thierstein
*Attorney, Agent, or Firm*—Marthe L. Gibbons

[57] ABSTRACT

A catalytic slurry hydroconversion process for producing normally liquid hydrocarbons from a heavy hydrocarbonaceous oil and from coal is performed in at least two stages in series. The heavy oil is introduced into the first hydroconversion stage and the coal is introduced into any of the hydroconversion stages other than the first stage.

17 Claims, 1 Drawing Figure

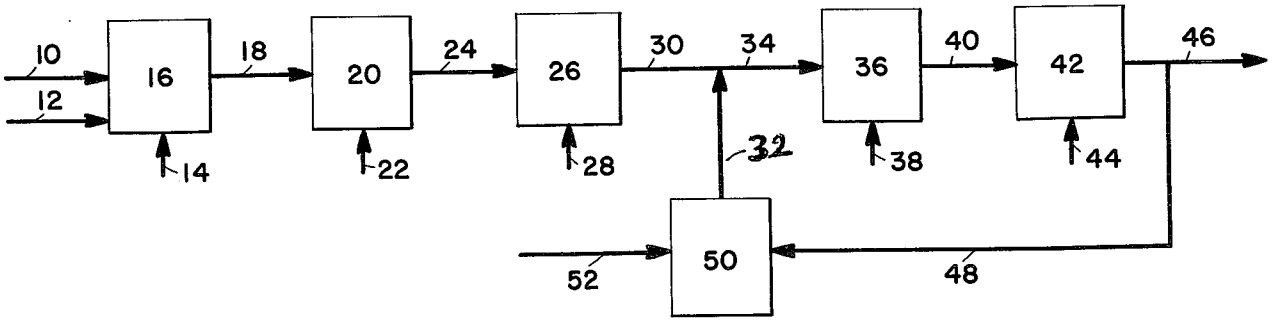
10
12
16
14
18
20
22
24
26
28
30
34
32
36
38
40
42
44
46
48
50
52

STAGED HYDROCONVERSION OF AN OIL-COAL MIXTURE

CROSS REFERENCE TO RELATED APPLICATIONS

This application is a continuation-in-part of U.S. application Ser. No. 702,271 filed July 2, 1976, the teachings of which are hereby incorporated by specific reference.

BACKGROUND OF THE INVENTION

1. Field of the Invention

This invention relates to a staged process for simultaneously converting coal to liquid hydrocarbon products and hydroconverting a heavy hydrocarbonaceous oil in the presence of a catalyst prepared in situ from small amounts of metals added to a mixture of oil and coal as oil soluble metal compounds.

2. Description of the Prior Art

Hydrorefining processes utilizing catalysts in admixture with a hydrocarbonaceous oil are well known. The term "hydrorefining" is intended herein to designate a catalytic treatment, in the presence of hydrogen, of a hydrocarbonaceous oil to upgrade the oil by eliminating or reducing the concentration of contaminants in the oil such as sulfur compounds, nitrogenous compounds, metal contaminants and/or to convert at least a portion of the heavy constituents of the oil, such as pentane-insoluble asphaltenes or coke precursors, to lower boiling hydrocarbon products and to reduce the Conradson carbon residue of the oil.

U.S. Pat. No. 3,161,585 discloses a hydrorefining process in which a petroleum oil chargestock containing a colloidally dispersed catalyst selected from the group consisting of metals of Group VB and VIB, an oxide of said metal or a sulfide of said metal is reacted with hydrogen at hydrorefining conditions. This patent teaches that the concentration of the dispersed catalyst, calculated as the elemental metal, in the oil chargestock is from about 0.1 weight percent to about 10 weight percent of the initial chargestock.

U.S. Pat. No. 3,331,769 discloses a hydrorefining process in which a metal component (Group VB, Group VIB, iron group metal) colloidally dispersed in a hydrocarbonaceous oil is reacted in contact with a fixed bed of a conventional supported hydrodesulfurization catalyst in the hydrorefining zone. The concentration of the dispersed metal component which is used in the hydrorefining stage in combination with the supported hydrodesulfurization catalyst ranges from 250 ppm to 2,500 ppm.

U.S. Pat. No. 3,657,111 discloses a process for hydrorefining an asphaltene-containing hydrocarbon chargestock which comprises dissolving in the chargestock a hydrocarbon-soluble oxovanadate salt and forming a colloidally dispersed catalytic vanadium sulfide in situ within the chargestock by reacting the resulting solution, at hydrorefining conditions with hydrogen and hydrogen sulfide.

It is also known to convert coal to liquid products by hydrogenation of coal which has been impregnated with an oil soluble metal naphthenate or by hydrogenation of coal in a liquid medium, such as an oil having a boiling range of 250° to 325° C., containing an oil soluble metal naphthenate, as shown in Bureau of Mines Bulletin No. 622, published 1965, entitled "Hydrogenation of Coal in the Batch Autoclave", pages 24 to 28.

Concentrations as low as 0.01 percent metal naphthenate catalysts, calculated as the metal, were found to be effective for the conversion of coal.

In U.S. application Ser. No. 702,271 it has been proposed to convert simultaneously a heavy hydrocarbonaceous oil and coal in the presence of hydrogen and of a catalyst produced in the oil by the thermal decomposition of a minor amount of an oil soluble metal compound of Groups VB, VIB, VIIB, VIII and mixtures thereof of the Periodic Table of Elements. It has now been found that certain advantages result when the hydroconversion process is conducted in stages. The heavy hydrocarbonaceous oil with the catalyst or with the catalyst precursor is introduced into a first hydroconversion zone. The first hydroconversion zone effluent is passed to one or more subsequent hydroconversion stages. Coal is introduced into any of the hydroconversion stages except into the first stage. The staged process permits regulation of reaction time separately for the heavy oil and for the coal.

The term "hydroconversion" with reference to the oil is used herein to designate a catalytic process conducted in the presence of hydrogen in which at least a portion of the heavy constituents and coke precursors (as measured by Conradson carbon residue) of the hydrocarbonaceous oil are converted at least in part to lower boiling hydrocarbon products while simultaneously reducing the concentration of nitrogenous compounds, sulfur compounds and metallic contaminants.

The term "hydroconversion" with reference to coal is used herein to designate a catalytic conversion of coal to liquid hydrocarbons in the presence of hydrogen.

SUMMARY OF THE INVENTION

In accordance with the invention, there is provided a staged process for hydroconverting a non-hydrogen donor heavy hydrocarbon oil and coal, which comprises: (a) adding to said heavy oil an oil soluble metal compound of a metal selected from the group consisting of Groups IVB, VB, VIB, VIIB and VIII of the Periodic Table of Elements and mixtures thereof; (b) converting said oil soluble metal compound to a catalyst within said oil in the presence of a hydrogen-containing gas by heating said oil to an elevated temperature; (c) reacting the oil containing said catalyst with hydrogen under oil hydroconversion conditions in a first hydroconversion zone; (d) passing at least a portion of said first hydroconversion zone effluent to at least one additional hydroconversion zone maintained at coal hydroconversion conditions; (e) introducing coal into said additional hydroconversion zone, and (f) recovering a hydroconverted normally liquid hydrocarbon product.

BRIEF DESCRIPTION OF THE DRAWINGS

The FIGURE is a schematic flow plan of one embodiment of the invention.

DETAILED DESCRIPTION OF THE INVENTION

The process of the invention is generally applicable to mixtures comprising coal and hydrocarbonaceous oil. The term "coal" is used herein to designate a normally solid carbonaceous material including all ranks of coal, such as anthracite coal, bituminous coal, semibituminous coal, subbituminous coal, lignite, peat and mixtures thereof.

Suitable heavy hydrocarbonaceous oils for use in the process of the invention are non-hydrogen donor oils, that is, oils having less than 0.8 weight percent donatable hydrogen under process conditions. The non-hydrogen donor heavy oils include heavy mineral oils; whole or topped petroleum crude oils, including heavy crude oils; asphaltenes; residual oils such as petroleum atmospheric distillation tower residua (boiling above about 650° F., i.e. 343.33° C.) and petroleum vacuum distillation tower residua (vacuum residua boiling above about 1,050° F., i.e. 565.56° C.); tars, bitumens; tar sand oils; shale oils, etc. Particularly well suited oils are heavy crude oils and residual oils which generally contain a high content of metallic contaminants (nickel, iron, vanadium) usually present in the form of organometallic compounds, e.g. metalloporphyrins, a high content of sulfur compounds and a high content of nitrogenous compounds and a high Conradson carbon residue. The metal content of such oils may range up to 2,000 wppm or more and the sulfur content may range up to 8 weight percent or more. The API gravity at 60° F. of such oils may range from about −5° API to about +35° API and the Conradson carbon residue of the heavy oil may generally range from about 5 to about 50 weight percent (as to Conradson carbon residue, see ASTM test D-189-65). Preferably the hydrocarbonaceous oil is a heavy hydrocarbon oil having at least 10 weight percent of material boiling above 1,050° F. (565.56° C.) at atmospheric pressure, more preferably having more than about 25 weight percent of material boiling above 1,050° F. (565.56° C.) at atmospheric pressure. To the heavy hydrocarbon oil is added from about 10 to less than 1,000 weight ppm, preferably from about 25 to about 950 wppm, more preferably from about 50 to 300 wppm, most preferably from about 50 to 200 wppm, of an oil soluble metal compound wherein the metal is selected from the group consisting of Groups IVB, VB, VIB, VIIB, VIII and mixtures thereof of the Periodic Table of Elements, said weight being calculated as if the compound existed as the elemental metal, based on the total initial chargestock of oil.

Suitable oil soluble metal compounds include (1) inorganic metal compounds such as halides, oxyhalides, heteropoly acids (e.g. phosphomolybdic acid, molybdosilicic acid); (2) metal salts of organic acids such as acyclic and alicyclic aliphatic carboxylic acids, containing two or more carbon atoms (e.g. naphthenic acids); aromatic carboxylic acids (e.g. toluic acid); sulfonic acids (e.g. toluenesulfonic acid); sulfinic acids; mercaptans; xanthic acids; phenols, di and polyhydroxy aromatic compounds; (3) organometallic compounds such as metal chelates, e.g. with 1,3-diketones, ethylene diamine, ethylene diamine tetraacetic acid, phthalocyanines, etc.; (4) metal salts of organic amines such as aliphatic amines, aromatic amines, and quaternary ammonium compounds.

The metal constituent of the oil soluble metal compound is selected from the group consisting of Groups IVB, VB, VIB, VIIB and VIII of the Periodic Table of Elements, and mixtures thereof, in accordance with the table published by E. H. Sargent and Company, copyright 1962, Dyna Slide Company, that is, titanium, zirconium, vanadium, niobium, tantalum, chromium, molybdenum, tungsten, manganese, rhenium, iron, cobalt, nickel, and the noble metals including platinum, iridium, palladium, osmium, ruthenium and rhodium. The preferred metal constituent of the oil soluble metal compound is selected from the group consisting of molybdenum, vanadium and chromium. More preferably, the metal constituent of the oil soluble metal compound is selected from the group consisting of molybdenum and chromium. Most preferably, the metal constituent of the oil soluble metal compound is molybdenum. Preferred compounds of the given metals include the salts of acyclic (straight or branched chain) aliphatic carboxylic acids, salts of alicyclic aliphatic carboxylic acids, heteropolyacids, hydrated oxides, carbonyls, phenolates and organo amine salts. One more preferred type of metal compound is the heteropoly acid, e.g. phosphomolybdic acid. Another more preferred metal compound is a salt of an alicyclic aliphatic carboxylic acid such as a metal naphthenate. The most preferred compounds are molybdenum naphthenate, vanadium naphthenate and chromium naphthenate. The mixture of hydrocarbonaceous oil and oil soluble metal compound is treated under the conditions of the present invention to form the catalst in situ in the oil.

Various methods can be used to convert the oil soluble metal compound in the oil to an active catalyst. A preferred method (pre-treatment method) of forming a catalyst from the oil soluble metal compound of the present invention is to heat the solution of said metal compound in the hydrocarbon oil to a temperature ranging from about 325° C. to about 415° C. and at a pressure ranging from about 500 to about 5,000 psig in the presence of a hydrogen-containing gas. Preferably, the hydrogen-containing gas also comprises hydrogen sulfide. The hydrogen sulfide may comprise from about 1 to about 90 mole percent, preferably from about 1 to 50 mole percent, more preferably from about 1 to 30 mole percent, of the hydrogen-containing gas mixture. The pretreatment is conducted for a period ranging from about 5 minutes to about 2 hours, preferably for a period ranging from about 10 minutes to about 1 hour. The thermal treatment in the presence of hydrogen or in the presence of hydrogen and hydrogen sulfide is believed to facilitate conversion of the metal compounds to the corresponding metal-containing active catalysts which act also as coking inhibitors. The oil containing the resulting catalyst is then introduced into a first hydroconversion zone which will be subsequently described.

Another method of converting the thermally decomposable metal compound of the present invention is to react the mixture of said compound in oil with a hydrogen-containing gas as hydroconversion conditions to produce a catalyst in the oil chargestock in situ in the first hydroconversion zone. The hydrogen-containing gas may comprise from about 1 to about 10 mole percent hydrogen sulfide. The thermal treatment of the metal compound and reaction with the hydrogen-containing gas or with the hydrogen and hydrogen sulfide produces the corresponding metal-containing conversion product which is an active catalyst. Whatever the exact nature of the resulting conversion products of the given metal compounds, the resulting metal component is a catalytic agent and a coking inhibitor.

The heavy hydrocarbonaceous oil with the catalyst or with the catalyst precursor is introduced into a first hydroconversion zone maintained at a temperature ranging from about 416° to about 538° C., preferably from about 426° C. to about 482° C. and a hydrogen partial pressure of 500 psig or higher, preferably from about 500 to 5000 psig partial pressure of hydrogen. Reaction time of about 3 minutes to about 5 hours may be used, preferably from about 5 minutes to about 2 hours, more preferably from about 15 minutes to about 1 hour. The first hydroconversion zone effluent is then passed to one or moe subsequent hydroconversion zones. Coal in particulate form, for example, of 8 mesh (Tyler) in diameter, is introduced into any of the hydroconversion zones except into the first reaction zone. The additional hydroconversion zone into which the coal is introduced is maintained at a temperature ranging from about 416° to about 538° C., preferably from about 426° C. to about 482° C. and a hydrogen partial pressure of about 500 to 5000 psig, preferably from about 1000 to 3000 psig, for a period of time ranging from about 3 minutes to about 5 hours, preferably from about 5 minutes to about 2 hours, and more preferably from about 15 minutes to about 1 hour. If desired, the effluent of the hydroconversion zone into which coal was introduced may be passed to additional hydroconversion zones. The product from the last hydroconversion zone is removed from the zone. The product comprises a normally liquid hydrocarbonaceous oil and solids. The solids may be separated from the last hydroconversion zone effluent by conventional means, for example, by settling or centrifuging of the slurry. At least a portion of the separated solids or solid concentrate may be recycled directly to one of the hydroconversion zones or recycled to the oil chargestock. Furthermore, if desired, a portion of the final hydroconversion zone product may be mixed with coal to form a slurry for introduction into the coal hydroconversion zone. The process of the invention may be conducted either as a batch process or as a continuous type operation.

DESCRIPTION OF THE PREFERRED EMBODIMENTS

The preferred embodiments will be described with reference to the accompanying FIGURE.

Referring to the FIGURE, a petroleum atmospheric residuum, that is, a fraction boiling from above about 650° F. (i.e. 343.3° C.) is introduced by line 10 into pretreatment zone 16. An oil soluble metal compound is introduced into pretreatment zone 16 by line 12. The oil soluble metal compound, for example, molybdenum naphthenate, is added to zone 16 in an amount such as to comprise less than 300 weight parts per million (wppm) calculated as if it exists as the elemental metal, based on the initial residuum chargestock. A gaseous mixture comprising hydrogen and from about 1 to about 50 mole percent hydrogen sulfide is introduced into pretreatment zone 16 by line 14. The pretreatment zone is maintained at a temperature ranging from about 325° C. to about 415° C. and at a total pressure ranging from about 500 to about 5000 psig. The pretreatment is conducted for a period of time ranging from about 10 minutes to about 1 hour. The pretreatment zone effluent is removed by line 18. If desired, a portion of the hydrogen sulfide may be removed from the effluent. The pretreatment zone effluent is introduced by line 18 into a first hydroconversion reactor 20. A hydrogen-containing gas is introduced into hydroconversion reactor 20 by line 22. The hydroconversion zone in reactor 20 is maintained at a temperature ranging from about 440° to about 468° C. and under a hydrogen partial pressure ranging from 1000 to 3000 psig. The first hydroconversion zone effluent is removed by line 24 and passed to a second hydroconversion reactor 26 maintained at the same conditions as the first hydroconversion reactor 20. A hydrogen-containing gas is introduced into hydroconversion reactor 26 by line 28. The oil containing the catalyst is introduced into the hydroconversion zones at a rate such as to give a total residence time of 15 minutes to 1 hour in reactor 20 and reactor 26. The effluent of hydroconversion reactor 26 is removed by line 30. Coal in particulate form is introduced into line 30 by line 32. The resulting mixture is passed by line 34 into a third hydroconversion reactor 36. A hydrogen-containing gas is introduced into hydroconversion reactor 36 by line 38. Reactor 36 is maintained at a temperature ranging from about 426° C. to about 482° C. and at a hydrogen partial pressure of about 1000 to 3000 psig. The effluent of reactor 36 is removed by line 40 and passed to hydroconversion reactor 42 into which is introduced a hydrogen-containing gas by line 44. The coal-oil mixture is introduced into reactor 36 at a rate such as to give a total residence time in reactors 36 and 42 of about 15 minutes to about 1 hour. The hydroconversion zone effluent of reactor 42 is removed by line 46. It comprises a normally liquid hydrocarbonaceous oil and solids. If desired, a portion of the effluent may be passed via line 48 to a mixing zone 50 into which is introduced coal via line 52. The slurry of coal and reaction zone effluent is removed via line 32 and introduced into line 30. Furthermore, a portion of the solids may be separated from the net product of line 46 and, if desired, a portion of the solids may be recycled to first hydroconversion reactor 20 or to the oil chargestock or to any of the subsequent hydroconversion reactors.

The following examples are presented to illustrate the invention.

EXAMPLE 1

Ten replicate autoclave experiments were done at a temperature of 438° C. and total reactor pressure was maintained above 2000 psig during the course of the reaction. The gas used was 90–96% $H_2$ and 4–10% $H_2S$. The feed was a 50/50 wt. mixture of Athabasca bitumen and 200 mesh Wyodak coal. Reaction time was 1.5 hr. and the molybdenum concentration was 206 ppm added as molybdenum naphthenate. The percentages of the carbon in the total feed which went to various products were as follows: $CO + CO_2$, 2.14%; $C_1$–$C_3$ hydrocarbon, 4.32%; char, 1.58%, oil, 91.96%. The hydrogen consumption was 1877 standard cubic feet per 350 pounds of feed.

The liquid products were composited and distilled. Results are tabulated in Table I together with the hydrogen consumption translated into SCF/bbl. of liquid product.

EXAMPLE 2

An experiment similar to Example 1 was carried out with Athabasca bitumen alone and results are tabulated in Table I.

TABLE I

| Run | 1 | 2 | Calculated from runs 1 and 2 |
|---|---|---|---|
| LIQUID PRODUCT, VOL. % ON ATHABASCA FEED | 50/50 ATHABASCA WYODAK | ATHABASCA ONLY | NET FROM COAL |
| $C_4$-380° F. | 51 | 13 | 38 |
| 380–550° F. | 32 | 39 | 14 |
| 550–650° F. | 21 | | |
| 650–1050° F. | 51 | 39 | 12 |
| 1050° F.+ | 13 | 11 | 2 |
| | 168 | 102 | 66 |
| $H_2$ CONSUMPTION, SCF/BBL. PRODUCT | 2400 | 800 | 4800 |

As can be seen from the data of Table I, coal is predominantly converted to naphtha and light distillates. This leads to larger than desired hydrogen consumption.

EXAMPLE 3

An experiment similar to Example 1 was carried out with the molybdenum concentration being 104 ppm added as phosphomolybdic acid. The percentages of the carbon in the total feed which went to the various products were as follows: $CO + CO_2$, 2.41; $C_1$–$C_3$ hydrocarbon, 4.47; char, 1.38; oil, 91.74.

EXAMPLE 4

An experiment (run 3) was done wherein the Athabasca bitumen alone was given a first stage treatment for 1 hour under the conditions of Example 1 with the molybdenum concentration being 199 ppm added as phosphomolybdic acid. Then the liquid from this treatment was mixed with an equal weight of 200 mesh Wyodak coal, together with enough added phosphomolybdic acid to maintain the molybdenum concentration at 200 ppm. This mixture was then given a second stage 30 minute hydroconversion treatment under the same conditions as the first stage. The percentages of the carbon in the total feed which went to the various products were as follows: $CO + CO_2$, 1.93%; $C_1$–$C_3$ hydrocarbon, 3.69%; char, 5.44%, oil, 88.96%. Hydrogen consumption was 1634 SCF/350 pounds of total feed. Results are compared with the single stage operation in Table II.

TABLE II

STAGED CO-CONVERSION REDUCES HYDROGEN CONSUMPTION
50/50 Athabasca/Wyodak, 820° F.

| Type Operation | 1-stage | 2-stage |
|---|---|---|
| Run # | 1 | 3 |
| Oil, treat time, min. | 90 | 60 + 30 |
| Coal treat time, min. | 90 | 30 |
| $H_2$consumption SCF/350 pounds feed | 1877 | 1634 |
| % 1006° F. + bottoms on Oil product | 14.4 | 19.2 |
| % yields | | |
| $C_1$–$C_3$ gas | 4.32 | 3.69 |
| Char | 1.58 | 5.44 |
| Oil | 91.96 | 88.96 |

As can be seen from the data of Table II, the staged co-conversion of bitumen and coal produced less light products and, therefore, resulted in less hydrogen consumption.

What is claimed is:

1. A staged process for hydroconverting a non-hydrogen donor heavy hydrocarbon oil and coal, which comprises:

(a) adding to said heavy oil an oil soluble metal compound of a metal selected from the group consisting of Groups IVB, VB, VIB, VIIB and VIII of the Periodic Table of Elements and mixtures thereof;

(b) converting said oil soluble metal compound to a catalyst within said oil in the presence of a hydrogen-containing gas by heating said oil to an elevated temperature;

(c) reacting the oil containing said catalyst with hydrogen under oil hydroconversion conditions in a first hydroconversion zone;

(d) passing at least a portion of said first hydroconversion zone effluent to at least one additional hydroconversion zone maintained at coal hydroconversion conditions;

(e) introducing coal into said additional hydroconversion zone, and (f) recovering a hydroconverted normally liquid hydrocarbon product.

2. The process of claim 1 wherein prior to passing said portion of said first hydroconversion zone effluent to said additional hydroconversion zone into which said coal is introduced, said first hydroconversion zone effluent is passed to one or more additional oil hydroconversion zones in series.

3. The process of claim 1 wherein at least a portion of the effluent of said additional hydroconversion zone of step (d) is passed to one or more subsequent hydroconversion zones in series.

4. The process of claim 1 wherein said hydroconversion process is conducted in a plurality of stages in series and wherein a portion of the effluent of the final stage of said series is mixed with said coal and the resulting mixture is introduced into any stage of said series of stages except said first stage.

5. The process of claim 1 wherein said first stage is maintained at a temperature ranging from about 416° to 538° C. and at a pressure ranging from about 500 to 5000 psig and wherein said additional stage into which coal is introduced is maintained at a temperature ranging from about 416° C. to about 538° C. and at a pressure ranging from about 1000 psig to about 3000 psig.

6. The process of claim 1 wherein said oil soluble metal compound in step (a) is added in an amount ranging from about 10 to about less than 1000 weight parts per million, calculated as the elemental metal, based on said heavy oil.

7. The process of claim 1 wherein said oil soluble metal compound in step (a) is added in an amount ranging from about 25 to about 950 wppm, calculated as the elemental metal, based on said heavy oil.

8. The process of claim 1 wherein said oil soluble metal compound is selected from the group consisting of inorganic metal compounds, salts of organic acids, organometallic compounds and salts of organic amines.

9. The process of claim 1 wherein said oil soluble metal compound is selected from the group consisting of salts of acyclic aliphatic carboxylic acids and salts of alicyclic aliphatic carboxylic acids.

10. The process of claim 1 wherein said oil soluble metal compound is a salt of naphthenic acid.

11. The process of claim 1 wherein the metal constituent of said oil soluble metal compound is selected from the group consisting of molybdenum, chromium and vanadium.

12. The process of claim 1 wherein said oil soluble metal compound is molybdenum naphthenate.

13. The process of claim 1 wherein said hydrogen-containing gas of step (b) comprises from about 1 to about 90 mole percent hydrogen sulfide.

14. The process of claim 1 wherein said oil soluble metal compound is converted to said catalyst by first heating the mixture of said oil soluble metal compound and oil to a temperature ranging from about 325° C. to about 415° C. in the presence of said hydrogen-containing gas to form a catalyst within said mixture and subsequently reacting the resulting mixture containing the catalyst with hydrogen under hydroconversion conditions in said first hydroconversion zone.

15. The process of claim 14 wherein said hydrogen-containing gas also contains hydrogen sulfide.

16. The process of claim 1 wherein said oil soluble metal compound is converted to said catalyst in the presence of a hydrogen-containing gas at hydroconversion conditions in said first hydroconversion zone thereby forming said catalyst in situ within said oil and in situ in said first hydroconversion zone.

17. The process of claim 1 wherein said hydroconversion process is conducted in a plurality of stages in series and wherein the hydroconversion product effluent of the last stage of said stages comprises a hydroconverted oil containing solids, and wherein at least a portion of said solids is separated from said hydroconverted oil and said separated portion of solids is recycled to step (a) or to step (c).

* * * * *